United States Patent [19]

Campbell

[11] Patent Number: 4,974,783

[45] Date of Patent: Dec. 4, 1990

[54] DISPENSER CABINET FOR DISPENSING SHEET MATERIAL

[75] Inventor: William E. Campbell, Antioch, Calif.

[73] Assignee: James River Corporation, Oakland, Calif.

[21] Appl. No.: 429,042

[22] Filed: Oct. 30, 1989

[51] Int. Cl.[5] ..... B65H 19/00

[52] U.S. Cl. ..... 242/55.53; 242/75.42; 312/38

[58] Field of Search ..... 242/55.2, 55.53, 75.4, 242/156.1; D6/518, 522, 523; 312/38

[56] References Cited

U.S. PATENT DOCUMENTS

| | | | |
|---|---|---|---|
| 3,034,738 | 5/1962 | Kuhn | 242/55.2 |
| 4,013,240 | 3/1977 | Perrin | 242/55.53 |
| 4,610,407 | 9/1986 | Stubbmann | 242/55.2 |
| 4,614,312 | 9/1986 | Del Pino | 242/55.2 |

*Primary Examiner*—Daniel P. Stodola
*Assistant Examiner*—William G. Battista, Jr.
*Attorney, Agent, or Firm*—Thomas R. Lampe

[57] ABSTRACT

A dispenser cabinet for dispensing sheet material from a wound roll having a groove at at least one end thereof including support members supporting the ends of the roll and a projection extending from at least one of the support members positionable in the groove and frictionally engaging the roll to stabilize the roll and resist rotation thereof.

3 Claims, 3 Drawing Sheets

DISPENSER CABINET FOR DISPENSING SHEET MATERIAL

TECHNICAL FIELD

This invention relates to a dispenser cabinet for dispensing sheet material from a wound roll of such material having bearing surfaces at opposed ends thereof. More particularly, the invention is directed to an improved arrangement for supporting and stabilizing the wound roll. Although the teachings of the present invention have applicability to dispenser cabinets for any type of wound roll product, it has special application to dispenser cabinets which dispense toweling from relatively large diameter paper towel rolls. The arrangement of the invention not only stabilizes such a large roll but also serves the function of resisting inadvertent unwinding of toweling from a large roll caused by rotating roll inertia.

BACKGROUND ART

A wide variety of dispenser cabinets for dispensing paper toweling from a roll are in commercial use. Conventionally, the paper towel rolls include bearing surfaces at opposed ends thereof. These bearing surfaces may, for example, simply comprise the open ends of a core incorporated in the roll. Other paper towel roll products exist wherein grooves or indents are formed in the paper toweling itself to form the bearing surfaces.

Regardless of the nature of the bearing surfaces incorporated in the paper towel roll product, it is well known to support the wound roll in a dispenser cabinet by means of support members attached to the cabinet housing and which include support elements engageable with the bearing surfaces at opposed ends of the wound roll to support the wound roll. During dispensing of toweling from the cabinet, the wound roll rotates on the support elements and gradually diminishes in size.

Problems are encountered when dispenser cabinets are employed to dispense sheet material from a relatively large, heavy roll of material such as paper towel rolls having diameters in the order of eight inches or so. Such rolls are now in widespread usage. The larger the roll, in general, the heavier and less stable it is. The combination of increased weight and instability during rotation can cause inadvertent dislodgment of the bearing surfaces from the support elements.

The use of these large diameter rolls in dispensing cabinets also creates another problem. As toweling is withdrawn during the dispensing operation, the inertia of a large rotating roll can cause it to "free-wheel" within the cabinet. In other words, more toweling may be unwound from the roll than is actually dispensed from the cabinet. This surplus of toweling can interfere with the proper operation of the dispenser cabinet.

To prevent such excessive rotation it is known to frictionally engage the outer surface of a roll product with a spring-like band partially extending about the periphery of the roll product and attached to the housing. This arrangement has been found to be less than satisfactory since the frictional forces exerted thereby vary considerably as toweling is dispensed from the roll. That is, the frictional forces exerted by the band diminish in magnitude in a relatively uncontrolled manner as the towel roll is depleted. Also, variation in the diameter of roll products inserted into cabinets of this prior art type can cause great differences in the frictional forces initially exerted by the band.

BRIEF SUMMARY OF THE INVENTION

The present invention includes a structural arrangement for stabilizing a wound roll within a dispenser cabinet and preventing "free-wheeling" thereof during the dispensing function.

A dispenser cabinet constructed in accordance with the teachings of the present invention includes a housing and support members attached to the housing. The support members include support elements engageable with the bearing surfaces of a wound roll of material at opposed ends thereof to support the wound roll. The support members have distal end portions spaced from the support elements thereof.

The wound roll of sheet material includes a circular-shaped groove formed at least one end thereof and spaced from the bearing surfaces. At least one projection is formed on a support member and positionable within the groove in frictional engagement with the sheet material when the support elements engage the bearing surfaces. This arrangement not only frictionally resists rotation of the wound roll about the support elements but also stabilizes the wound roll.

Of course, as a roll diminishes in diameter during normal dispensing operations, it naturally becomes lighter, less likely to wobble or act in some other unstable manner during rotation, and less prone to "free wheel" due to roll inertial characteristics. The groove disappears when the roll reaches a predetermined smaller diameter and the projection does not frictionally engage the roll when this occurs. Thus the projection and groove have a cooperative relationship only when such is required.

Other features, advantages, and objects of the present invention will become apparent with reference to the following detailed description and accompanying drawings.

BEST MODE FOR CARRYING OUT THE INVENTION

Figure 1:
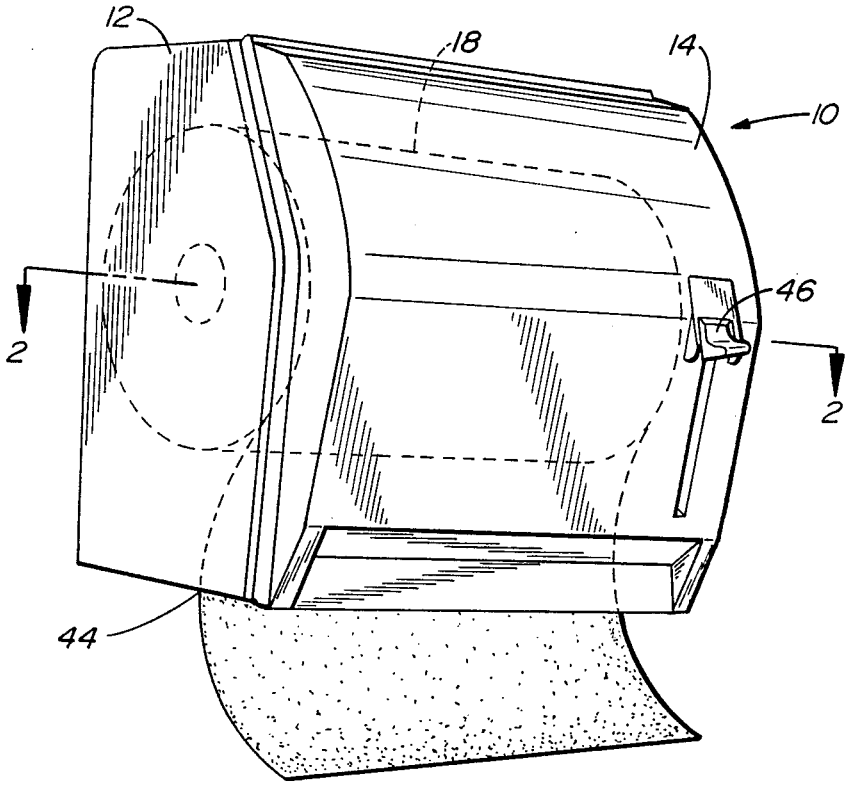
FIG. 1 is a perspective view of the outside of a closed dispenser cabinet constructed in accordance with the teachings of the present invention.

Referring now to the drawings, a dispenser cabinet constructed in accordance with the teachings of the present invention is designated generally by reference numeral 10. The cabinet 10 includes a housing 12 and a cover 14 pivotally mounted at the bottom thereof to the bottom of housing 12 in any known manner whereby the cover may be pivoted between an open position whereat the interior of the housing is accessible and the closed position illustrated in FIG. 1. The housing and cover may be constructed of any suitable material. Plastic is often utilized in the construction of components of this nature. It will be appreciated that a suitable latch mechanism (not shown) is employed to maintain the cover in its illustrated closed position. Since such expedients are well known in the art, a latch has not been illustrated.

Figure 4:
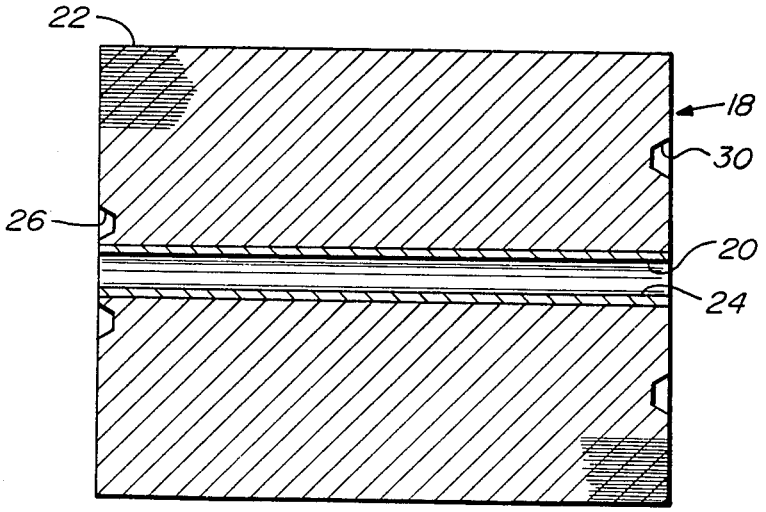
FIG. 4 is a cross-sectional view of a roll of sheet material adapted to be positioned in the dispenser cabinet for dispensing thereby.

Referring now specifically to FIG. 4, a roll product of the type to be dispensed from dispenser cabinet 10 is illustrated. The roll of sheet material shown in FIG. 4 is in the nature of a paper towel roll 18 comprising a core 20 about which has been wound a web of paper toweling 22. The roll has bearing surfaces at opposed ends thereof which are utilized to support the roll in cabinet 10.

At one end of the roll, the bearing surface is defined by the inner peripheral wall 24 of core 20. At the other end of the roll, the bearing surface is defined by a groove 26 formed in the toweling itself. The groove may be formed during winding of the toweling or simply cut into the rolled toweling by a suitable tool. In any event, the bearing surface or groove 26 is closely adjacent to core 20 and extends completely thereabout.

A circular-shaped groove 30 is formed at the same end of the roll product as bearing surface 24. Groove 30 is located further away from the core 20 than is groove 26. In other words, groove 30 is closer to the outer peripheral surface of roll 18 than is the groove 26 defining a bearing surface.

Figure 2:
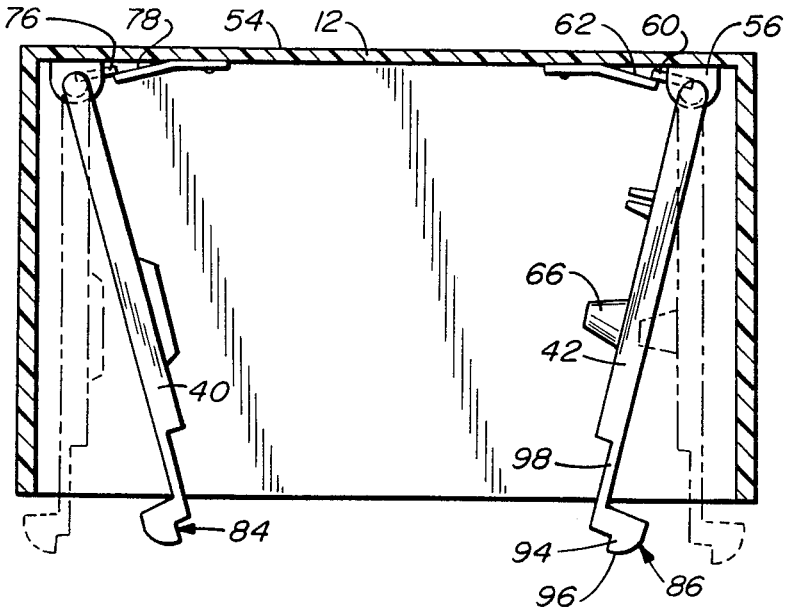
FIG. 2 is a diagrammatic, cross-sectional plan view of the cabinet housing taken along line 2—2 in FIG. 1 and illustrating the position assumed by support elements attached to the housing when not supporting a wound roll of sheet material.
Figure 2A:
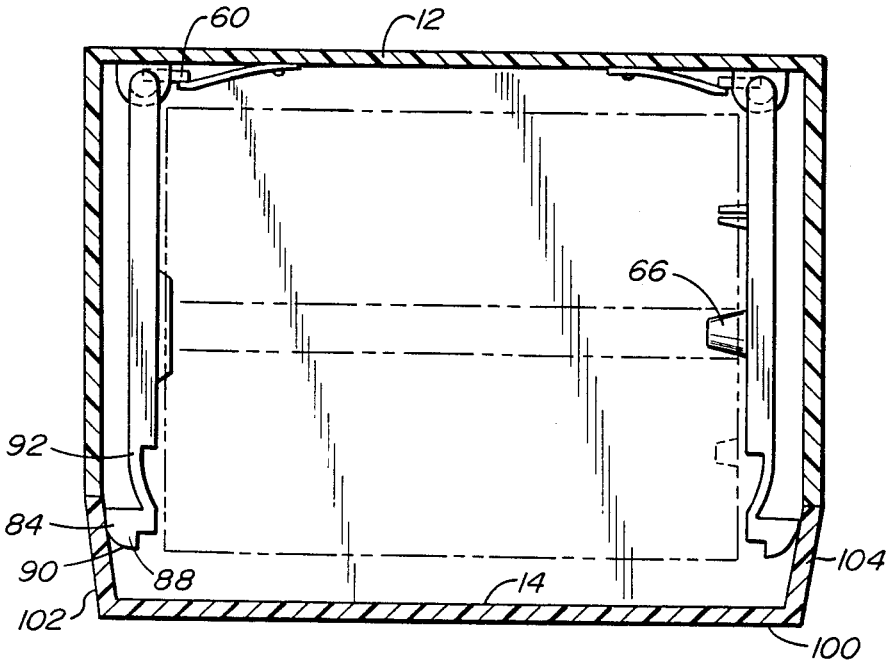
FIG. 2A is a view similar to FIG. 2 but illustrating the cooperative relationship existing between the dispenser cabinet support members and a cover closed in position in engagement with the cabinet housing.

Paper towel roll 18 is adapted to be supported within the interior of cabinet 10 in the position illustrated in phantom in FIG. 1, as well as in FIG. 2A. Support is provided by support members 40, 42 in a manner soon to be described. The toweling 22 of the paper towel roll 18 projects downwardly through a slot 44 formed in the cover 14 whereby access is had to the toweling by the consumer. Alternatively, of course, the slot may be formed in housing 12 rather than in the cover.

It will be appreciated that a suitable mechanism (not shown) is disposed within the interior of the housing 12 to dispense the toweling from the cabinet. Such mechanism may, for example, be operated by an actuator lever 46 projecting from the cover 14. Since the precise mode of dispensing the toweling from cabinet 10 comprises no part of the present invention and such mechanisms are in widespread use in conventional towel dispensing cabinets, the mechanism will not be described, nor is it illustrated.

Figure 3:
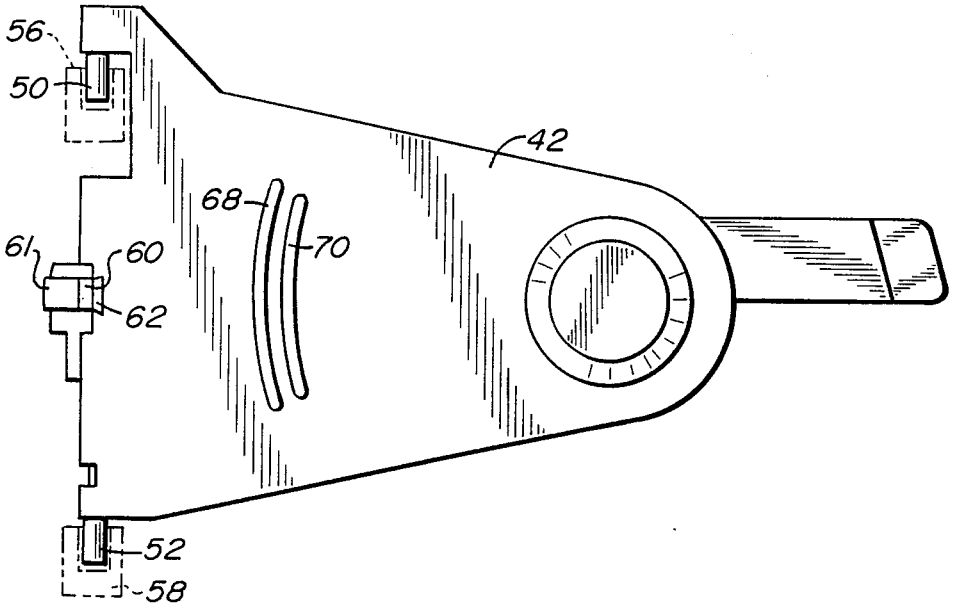
FIG. 3 is an enlarged, side view illustrating details of one of the support members.

Referring to FIGS. 2, 2A and 3, support member 42 is in the form of a double-ended arm. One end of the arm, the left end as viewed in FIG. 3, has pivot pins 50, 52 thereon. Pivot pins 50, 52 are positioned in suitable sockets attached to rear wall 54 of housing 12. These sockets are shown in phantom in FIG. 3 and identified by reference numerals 56, 58. The support member 42 is thus pivotally mounted relative to the housing. A tab 60 projects from the planar surface of the support member 42 and is continuously engaged by a spring 62 formed of spring metal or the like attached to wall 54. Thus, the support member 42 is continuously urged to the solid line position illustrated in FIG. 2 by the spring.

Support member 42 further includes a support element 66 in the form of a truncated cone. It will be appreciated that support element 66 is positionable into the core 20 of paper towel roll 18 and engages the bearing surface 24 to support the right end of roll 18 (as viewed in FIG. 2A).

Spaced from support element 66 and positioned in groove 30 of the paper towel roll 18 when the paper towel roll is mounted on support member 42 is a projection in the form of spaced, generally parallel arcuate ribs 68, 70. The arc of the ribs corresponds to the circular shape of groove 30 and is so configured as to frictionally engage the convolutions of the toweling 22 forming groove 30.

Preferably, the cross-section of groove 30 decreases in width as its depth increases; that is, the walls of the groove gradually converge. The outer surfaces of ribs 68, 70 are preferably tapered so that they converge at an angle generally corresponding to the convergence angle of the groove walls so that contact between the outer surfaces and groove walls is maximized. Naturally, the distance between the outer surfaces of ribs 68, 70 is selected so that such contact exists as long as the groove itself exists. That is, the ribs are sized and located so as to substantially continuously bear against the convolutions of toweling forming groove 30.

Figure 3A:
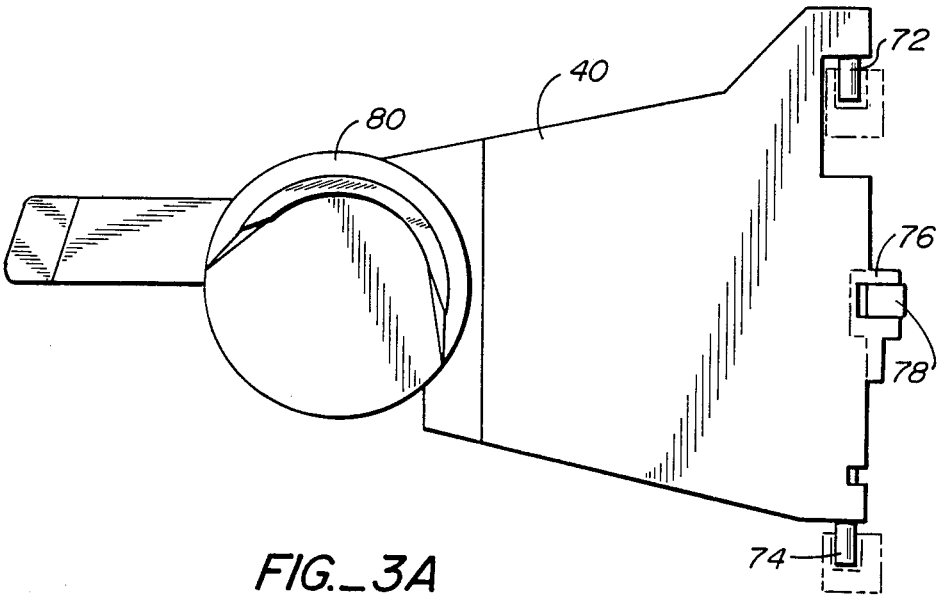
FIG. 3A is a view similar to FIG. 3 but illustrating the other of said support members.

Referring now also to FIG. 3A, support member 40 is also in a form of a double-ended arm with one of the ends thereof including pivot pins 72 74 which are also mounted in suitable sockets on the housing rear wall 54. Like support member 42, support member 40 also includes a tab 76 in continuous engagement with a spring 78 mounted on rear wall 54. Support member 40 differs from support member 42 in that support member 40 has a support element 80 in the form of a generally semi-circular shaped body projecting from the planar surface of support member 40. Support element 80 is so configured as to enter groove 26 when the roll 18 is mounted in the cabinet. Support element 80, therefore, supports the left end of the roll as viewed in FIG. 2A.

Such an arrangement will enable the roll 18 to drop away from support element 80 when the convolutions of toweling 22 forming groove 26 are depleted during dispensing by the cabinet. This feature is known in the prior art and does not form part of the present invention.

Support member 40 includes a distal end portion 84 which projects beyond housing 12. When the cover is open, the operator can grasp the distal end portion 84 and move it to the left, thus moving support member 40 clockwise (as viewed in FIGS. 2, 2A) against the urging of spring 78. A similar distal end portion 86 is incorporated in support member 42 and may be utilized to manipulate that support member as well. Thus, the paper towel roll 18 may be readily mounted in position in the housing.

Distal end portion 84 includes an enlarged head 88 defining a cam surface 90. Head 88 is attached to the rest of support member 40 by an arm section 92 of reduced thickness and having some degree of flexibility. Distal end portion 86 of support member 42 includes an enlarged head 94 defining a cam surface 96. Enlarged head 94 is connected to the rest of support member 42 by an arm section 98 of reduced thickness, flexible construction.

When a towel roll is mounted in the cabinet housing 12, the support members 40, 42 assume the phantom line positions illustrated in FIG. 2. It will be noted that in such positions, the distal end portions of the support members project beyond the housing. Also, the enlarged heads 88, 94 extend somewhat beyond the inner surfaces of the housing side walls. When the cabinet cover 14 is brought to closed position in engagement with the housing 12 as illustrated in FIG. 2A, the cover will engage the cam surfaces defined by the enlarged heads 88, 94 and urge the distal end portions inwardly toward one another.

This arrangement locks the support members 40, 42 in engagement with the paper towel roll supported by them. In other words, the cover is in operative association with the support members and cooperable therewith to resist displacement of the support elements out of engagement with the roll bearing surfaces.

As may perhaps best be seen with reference to FIG. 2A, the front wall 100 of cover 14 is shorter than rear wall 54 of housing 12 and the side walls 102, 104 of the cover taper outwardly in the direction of the housing. This construction further results in the inward biasing of the distal end portions 84, 86. Arm sections 92, 98 will bend as necessary to accommodate dimensional variations, a feature shown in exaggerated fashion in FIG. 2A.

During the dispensing operation, ribs 68, 70, as stated above, frictionally engage the convolutions of toweling 22 forming groove 30 whereby "free-wheeling" of the roll is resisted. In other words, the ribs act as a form of clutch mechanism which will resist to a degree rotation of the roll about support elements 66, 80. This frictional engagement ceases when the towel or other roll product is depleted at the location of such groove. When groove 30 disappears, of course, ribs 68, 70 do not inhibit rotation of the roll. This is precisely what is desired since the roll 18 has much less mass and consequent inertia when it is of reduced diameter. As stated above, "free-wheeling" is only a problem when the roll diameter is great.

Support members of types other than those specifically shown herein may be utilized when carrying out the teachings of the present invention. Also, other forms of biasing means may be employed to continuously urge one or both of the support members inwardly into engagement with the wound roll. For example, spring means other than springs 62, 78 can be used. If desired,-grooves may be formed at both ends of the roll and cooperable with ribs or other projections associated with both support members.

What is claimed is:

1. In a dispenser cabinet for dispensing sheet material from a wound roll of said material having centrally disposed bearing surfaces at opposed ends thereof and including a circular-shaped groove formed at least one end thereof and spaced outwardly from said bearing surfaces, said groove being defined by groove walls converging at a predetermined angle with the cross-section of said groove decreasing in width as the depth of the groove increases, the combination comprising:

a housing;

a pair of support members attached to said housing and including support elements engageable with the centrally disposed bearing surfaces at opposed ends of said wound roll to rotatably support said wound roll;

biasing means operatively associated with at least one of said support members for urging said support members toward each other and said support elements into engagement with said centrally disposed bearing surfaces to provide rotatable support for said wound roll; and a projection of arcuate configuration fixedly attached to one of said support members and projecting toward said other support member, said fixedly attached projection positionable within said groove and in frictional engagement with said sheet material when said support elements engage said bearing surfaces, said fixedly attached projection having tapered outer surfaces converging at an angle generally corresponding to the convergence angle of said groove walls, and said biasing means maintaining said fixedly attached projection tapered outer surfaces in slidable frictional engagement with said groove walls during rotation of said roll about said support elements to resist rotation of the wound roll during dispensing of said sheet material and stabilize sand wound roll.

2. The combination according to claim 1 wherein said projection comprises a plurality of spaced, generally parallel arcuate ribs.

3. The combination according to claim 1 wherein said pair of support members comprises a pair of spaced, double ended support arms, each of said support arms being pivotally attached to said housing at an end of said arm, and said biasing means comprising spring means operatively connected to each said arm and said housing.

* * * * *